United States Patent [19]

Nobileau et al.

[11] Patent Number: 4,903,776

[45] Date of Patent: Feb. 27, 1990

[54] CASING HANGER RUNNING TOOL USING STRING TENSION

[75] Inventors: Philippe C. Nobileau, Paris, France; Bradley D. Beitler, Houston, Tex.; Fergus D. S. McGhie, Aberdeen, Scotland

[73] Assignee: Vetco Gray Inc., Houston, Tex.

[21] Appl. No.: 285,791

[22] Filed: Dec. 16, 1988

[51] Int. Cl.[4] ..... E21B 33/043; E21B 23/04

[52] U.S. Cl. ..... 166/382; 166/182; 166/348; 166/383; 166/387; 285/18; 285/140

[58] Field of Search ..... 166/387, 381, 382, 383, 166/82, 86, 88, 348, 358, 368, 208, 212, 217; 285/18, 140, 141, 133.2

[56] References Cited

U.S. PATENT DOCUMENTS

| | | | |
|---|---|---|---|
| 4,595,053 | 6/1986 | Watkins et al. | 166/387 X |
| 4,597,448 | 7/1986 | Baugh | 166/348 |
| 4,712,621 | 12/1987 | Wightman et al. | 166/348 X |
| 4,736,799 | 4/1988 | Ahlstone | 285/141 X |
| 4,749,047 | 6/1988 | Taylor | 166/382 |
| 4,790,572 | 12/1988 | Slyker | 166/82 |

*Primary Examiner*—Stephen J. Novosad
*Attorney, Agent, or Firm*—James E. Bradley

[57] ABSTRACT

A tool for setting the packoff between the casing hanger and the wellhead utilizes differential area pistons. The tool has a mandrel which connects to a string of drill pipe. The mandrel carries a body and is axially movable relative to the body. A setting sleeves is carried by the body for connection to the packoff. A setting sleeve piston is carried by the body for relative movement relative to the body. A mandrel piston is carried by the mandrel for movement with the mandrel. Passages in the body communicate the mandrel piston with a setting sleeve piston and contain an incompressible fluid. Axial movement of the mandrel causes the pressure to increase to drive the setting sleeve piston downward to set the packoff.

7 Claims, 8 Drawing Sheets

CASING HANGER RUNNING TOOL USING STRING TENSION

BACKGROUND OF THE INVENTION

1. Field of the Invention

This invention relates in general to tools for running casing hangers in subsea wells, and in particular to a tool that utilizes pressure intensification through differential area pistons to set the packoff for a casing hanger.

2. Description of the Prior Art

The subsea well of the type concerned herein will have a wellhead supported on the subsea floor. One or more strings of casing will be lowered into the wellhead from the surface, each supported on a casing hanger. The casing hanger is a tubular member that is secured to the threaded upper end of the string of casing. The casing hanger lands on a landing shoulder in the wellhead, or on a previously installed casing hanger having larger diameter casing. Cement is pumped down the string of casing to flow back up the annulus around the string of casing. After the cement hardens, a packoff is positioned between the wellhead bore and an upper portion of the casing hanger. This seals the casing hanger annulus.

One type of packoff proposed utilizes a metal seal so as to avoid deterioration with time that may occur with elastomeric seals. Metal seals require a much higher force to set than elastomeric seals. Prior art running tools have employed various means to apply the downward force needed to set the packoff. Some prior art tools use rotation of the drill string to apply setting torque. It is difficult to achieve sufficient torque to generate the necessary forces for a metal packoff, because the running tool may be located more than a thousand feet below the water surface in deep water.

Other running tools and techniques shown in the patented art apply pressure to the annulus surrounding the drill string on which the running tool is suspended. The amount of annulus pressure is limited, however, to the pressure rating of the riser through which the drill string extends, which is normally not enough to set a metal packoff.

Higher pressures can be achieved by pumping through the drill string. However, this requires a running tool with some type of ports that are opened and closed from the surface. This is necessary because cement must first be pumped down the drill string. The ports may be opened and closed by dropping a ball or dart. This requires a considerable amount of time, however, for the ball to reach the seat. Rig time is quite expensive. Another method employs raising and lowering the drill pipe and rotating in various manners to engage and disengage J-slots to open and close ports. This has a disadvantage of the pins for the J-slots wearing and not engaging properly.

SUMMARY OF THE INVENTION

In this invention, axial movement of the drill string is used to set the packoff the force due to movement of the drill string is intensified by using differential pistons. The running tool has a mandrel that is connected to the drill string. The mandrel has a mandrel piston that moves with the mandrel. The mandrel carries a body that engages the casing hanger. The body has a setting sleeve piston that has a much larger pressure area than the mandrel piston. Sealed hydraulic passages connect the chamber of the mandrel piston with the chamber of the setting sleeve piston.

When setting the packoff, the drill string is lowered relative to the body to position the packoff between the casing hanger and the wellhead. Then the drill string is again moved axially to cause a pressure increase in the mandrel and setting sleeve chambers. In the embodiment shown, the drill string is picked up to cause this pressure increase.

The upward movement of the mandrel piston will apply hydraulic pressure to the liquid contained in the passages. This pressure acts on the setting sleeve piston, which in turn applies a downward force on the setting sleeve. The downward force of the setting sleeve will be much higher than the direct force from the lifting of the drill string because of the intensification due to the differential area pistons.

Preferably the body has two parts, an upper body and a lower body. The upper body is carried in an upper position while running the casing hanger and while cementing. Then, the mandrel and the upper body are lowered relative to the lower body to position the packoff assembly in the annular space between the casing hanger and wellhead. Then, the mandrel is lifted relative to both the upper body and lower body to apply hydraulic pressure to the setting sleeve piston.

DESCRIPTION OF THE PREFERRED EMBODIMENT

Figure 1A:
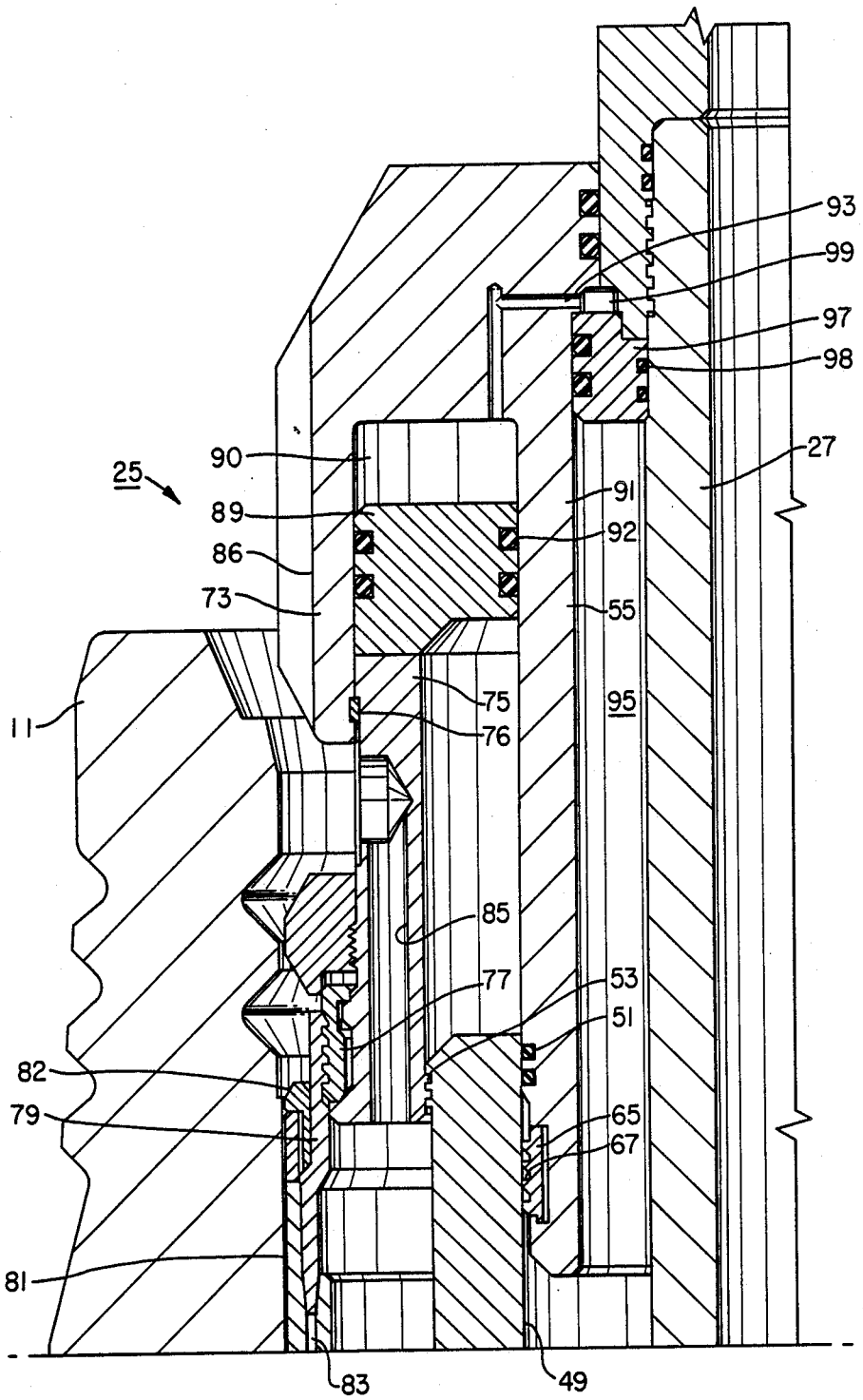
FIGS. 1*a* and 1*b* are quarter sectional views of a running tool constructed in accordance with this invention, and shown in the running in and cementing position.
Figure 1B:
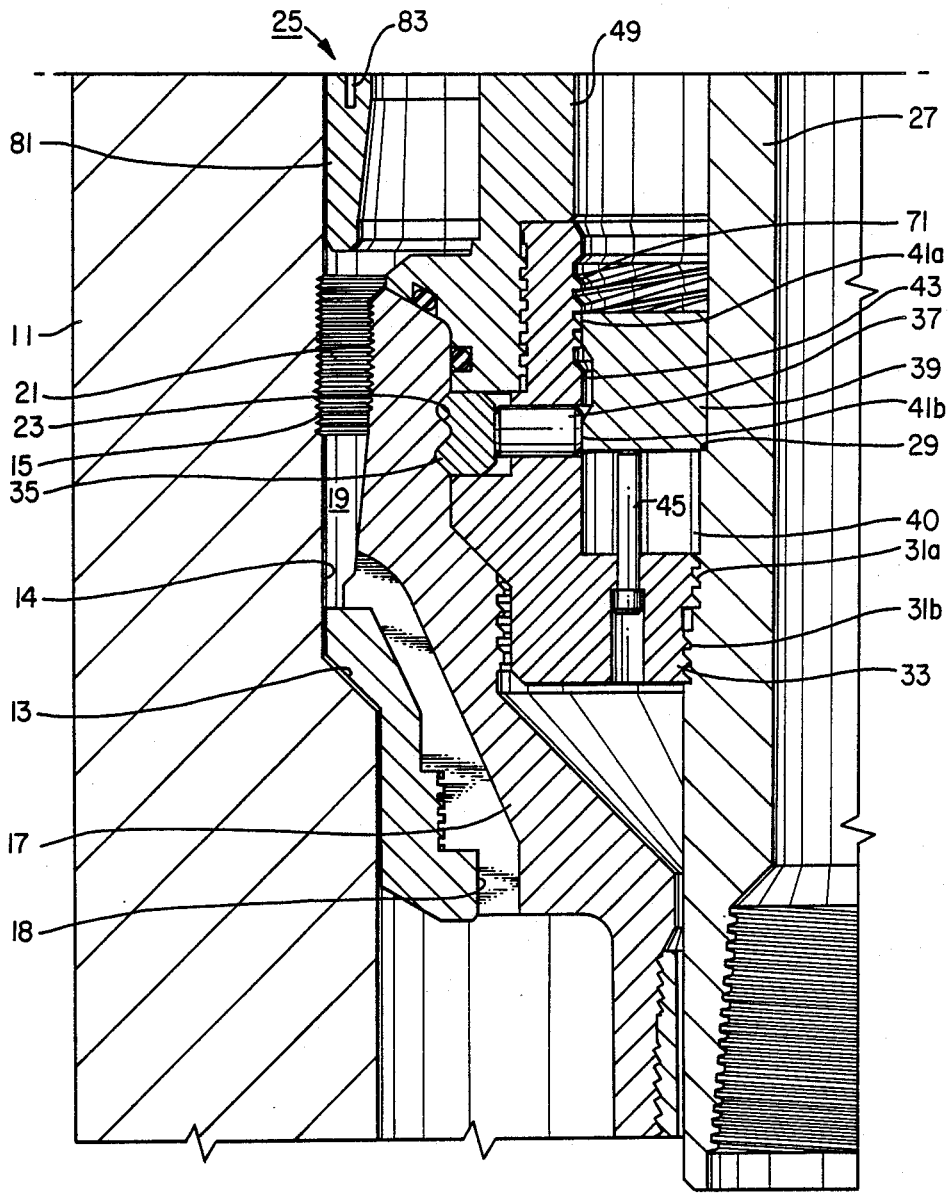

Referring to FIGS. 1*a* and 1*b*, and more particularly to FIG. 1*b*, wellhead is a tubular member extending upward from the subsea floor. An internal landing shoulder 13 is located in the bore 14 of the wellhead 11. Landing shoulder 13 is frustoconical. A set of wickers 15 is located a short distance above the landing shoulder 13. Wickers 15 are small, parallel, circumferential grooves.

A casing hanger 17 lands on the landing shoulder 13. Casing hanger 17 is a tubular member that is secured to the upper end of a string of casing (not shown). An annular clearance 19 exists between an upper portion of the casing hanger 17 and the bore 14 of the wellhead 11. Return flow passages 18 extend through the casing hanger 17 to return fluid from the annulus surrounding the casing with the annular clearance 19 during cementing before the casing hanger is fully set.

A set of wičkers 21 is formed on the casing hanger 17. Wickers 21 are of the same configuration, but extend upward farther and do not extend as far down as the wellhead wickers 15. Two large circumferential grooves 23 are located on the inner diameter of the upper portion of the casing hanger 17.

Casing hanger 17 is lowered into place and set by a running tool 25. Running tool 25 includes a mandrel 27 that has an upper end containing threads 26 (FIG. 3*a*) for connection to the lower end of the string of drill pipe (not shown). The drill pipe will be lowered through a riser (not shown) that extends from a floating vessel down to the wellhead 11. A shoulder 29 is secured to the lower end of the mandrel 27. Mandrel 27 has exterior threads 31*a*, 31*b*. The threads 31*b* are of larger diameter than the threads 31*a*. The threads 31*a*, 31*b* are adapted to screw into mating threads formed in a lower body 33.

An engaging element, preferably a split ring 35, is carried by the lower body 33. The ring 35 will extend from the exterior of the lower body 33. The ring 35 has a pair of annular bands separated by a groove on the outer side. The bands are adapted to mate with the grooves 23 in the casing hanger 17 to secure the lower body 33 to the casing hanger 17. Ring 35 will move between an extended position shown in FIG. 1*b* to a retracted position shown in FIG. 5*b*.

A plurality of linking pins 37 extend through the lower body 33 radially inward from the ring 35. The linking pins 37 are moved inward and outward by a cam 39, which is a solid ring. Cam 39 is carried inside a cavity 40 in the lower body 33. Cam 39 has a pair of lobes 41*a*, 41*b*, which are annular bands separated by a central recess 43. The cam 39 will move axially relative to the lower body 33.

Figure 2A:
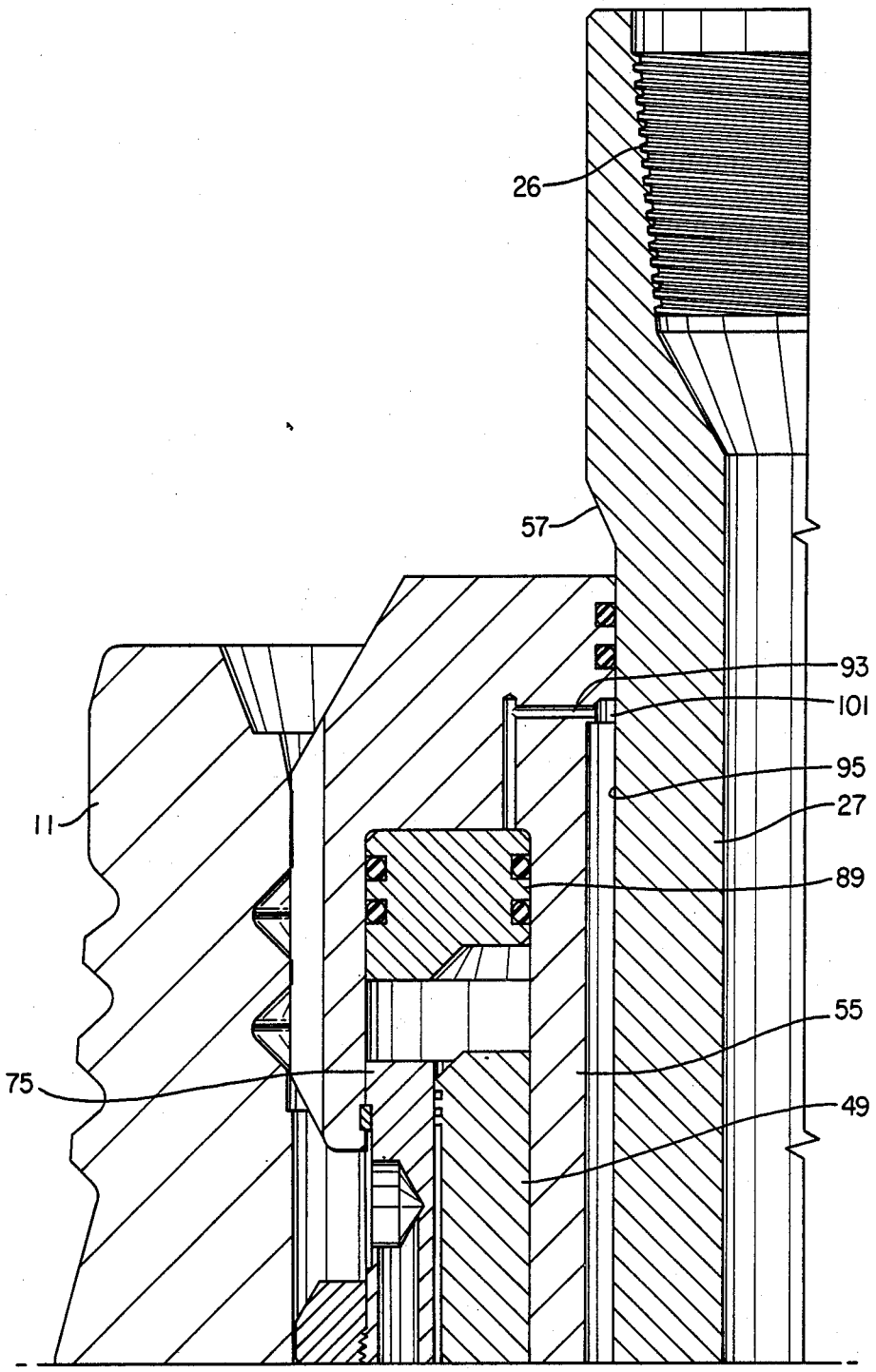
FIGS. 2*a* and 2*b* are quarter sectional views of the running tool of FIG. 1, showing the packoff being moved into position for setting after the casing hanger has been cemented.
Figure 2B:
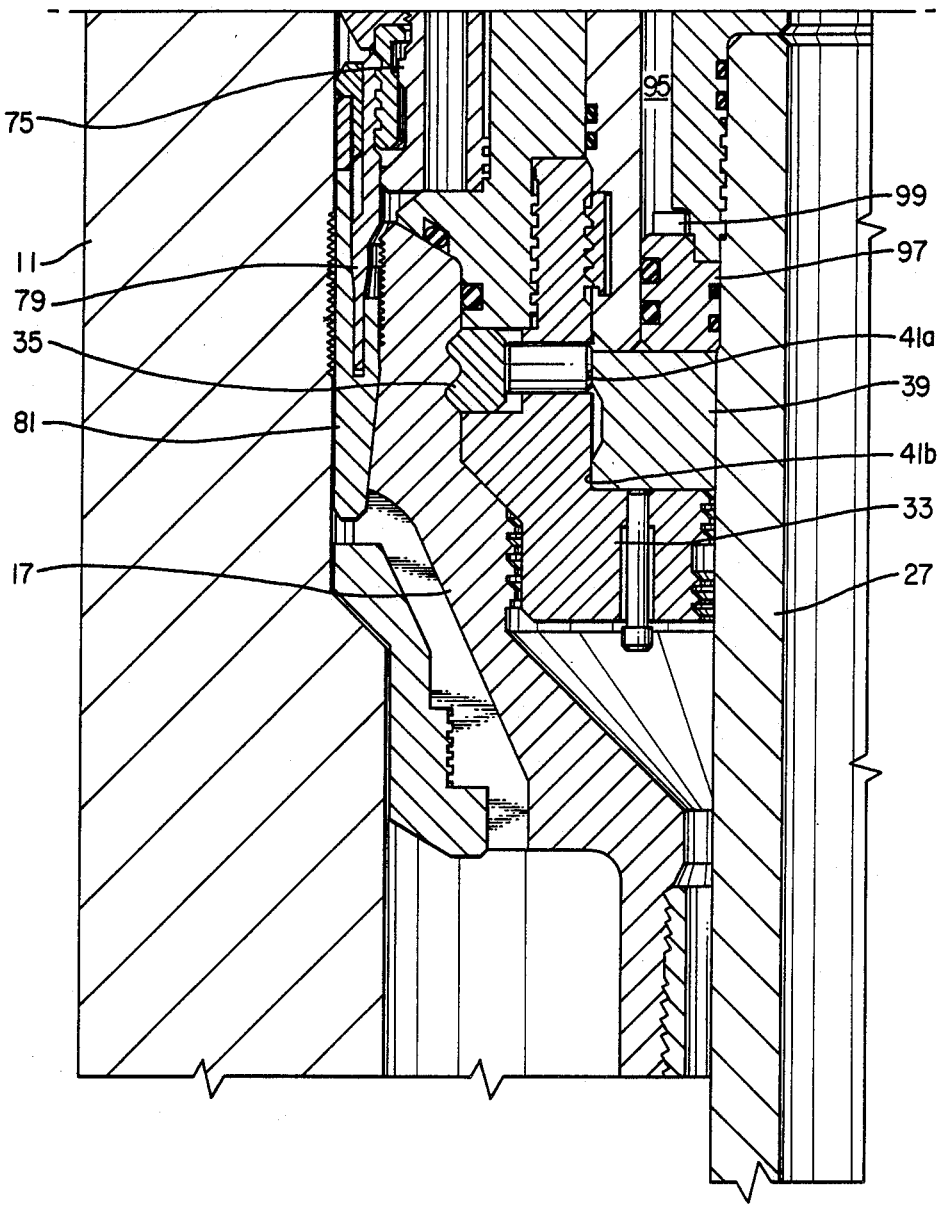
Figure 4A:
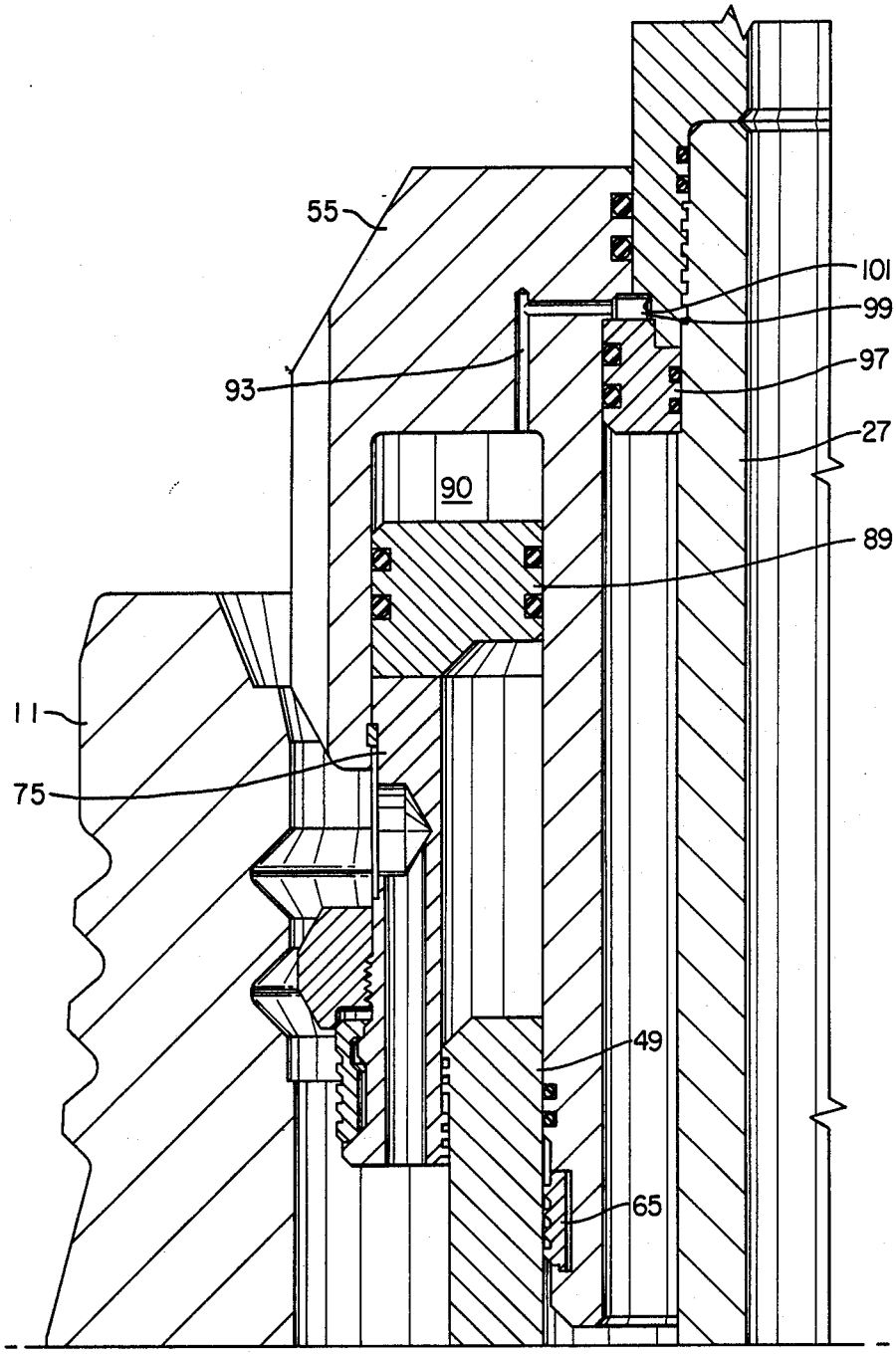
FIGS. 4*a* and 4*b* are quarter sectional views of the running tool of FIG. 1, showing the running tool released from the casing hanger.
Figure 4B:
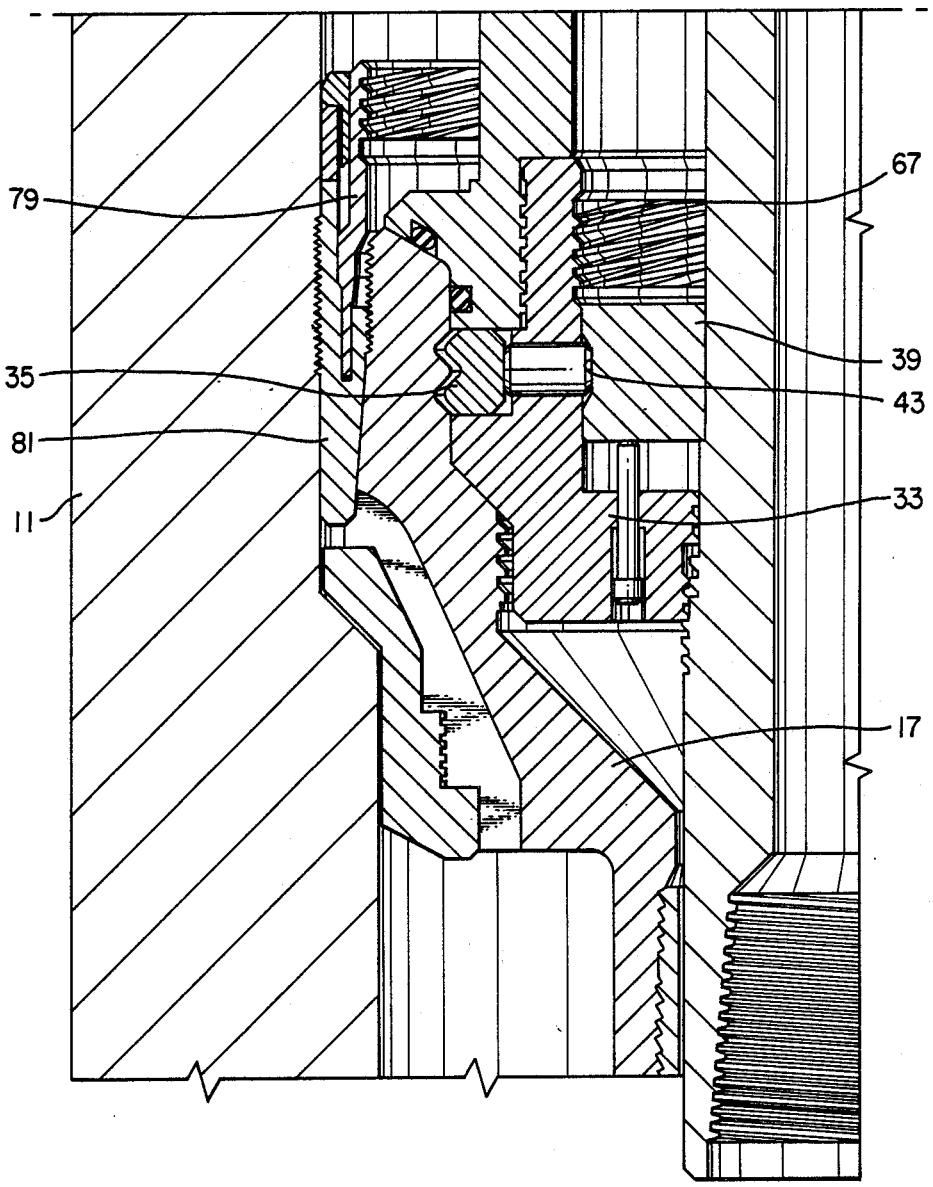

FIG. 1*b* shows the cam 39 in an upper position with the lower lobe 41*b* pressing the linking pins 37 and the ring 35 outward. FIG. 2*b* shows the cam 39 in a lower position, with the upper lobe 41*a* pressing the linking pins 37 and the ring 35 outward. FIG. 4*b* shows the cam 39 in an intermediate position, with the recess 43 engaging the linking pins 37, which allows the ring 35 to retract. The cam 39, linking pins 37 and ring 35 serve as connection means for releasably connecting the running tool 25 to the casing hanger 17.

The cam 39 is held in the upper and the intermediate positions by means of a shoulder 29 which engages the lower end of the cam 39. When the mandrel 7 is fully screwed into the lower body 33, the upper end of the shoulder 29 supports the cam 39 in the upper position. Pins 45 are secured to the cam 39 and extend through holes in the bottom of cavity 40. The pins 45 provide an upper limit for the movement of the cam 39.

In the position of FIG. 4*b*, the threads 31*a* and 31*b* have contacted the mating threads in the lower body 33, but have not yet been screwed into place. In this position, the shoulder 29 supports the cam 39 in the intermediate position.

The lower body 33 is preferably constructed in two parts, the upper portion 49 being secured by threads to the lower portion. Ring 35 locates in an annular space between the lower body 33 and its upper portion 49. The upper portion 49 of the lower body extends upward concentric with the mandrel 27. Inner and outer seals 51, 53 are located on the inner and outer diameters of this lower body upper portion 49.

Referring to FIG. 1*a*, the running tool 25 has an upper body 55. Upper body 55 has an upper position relative to the lower body 33 that is shown in FIGS. 1*a* and 1*b* and also in FIGS. 4*a* and 4*b*. In the other figures, the upper body 55 is located in a lower position relative to a lower body 33. The upper body 55 moves to the lower position by its own weight and by the contact of a downward facing shoulder 57 on the exterior of mandrel 27, which is shown in FIG. 2*a*.

A split latch ring 65 is carried on the exterior of the lower end of the upper body 55. Latch ring 65 has outer threads 67. The latch ring threads 67 are configured to ratchet past and engage mating threads 71 formed in the upper portion of the casing hanger cavity 40. The threads 67, 71 are of a saw-tooth configuration.

Figure 3A:
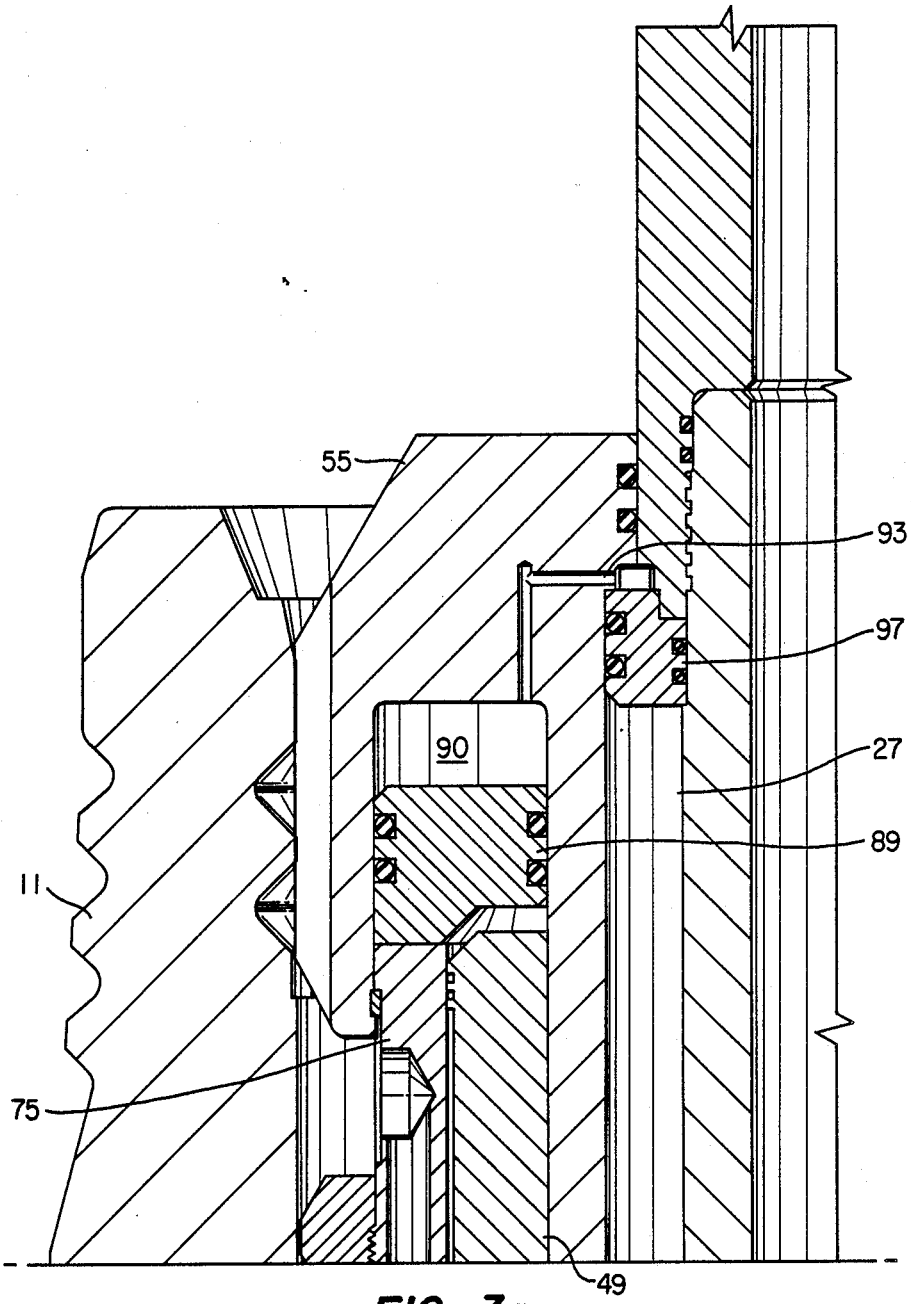
FIGS. 3*a* and 3*b* are quarter sectional views of the running tool of FIG. 1, showing the packoff when fully set, with the mandrel moved back to an upper position.
Figure 3B:
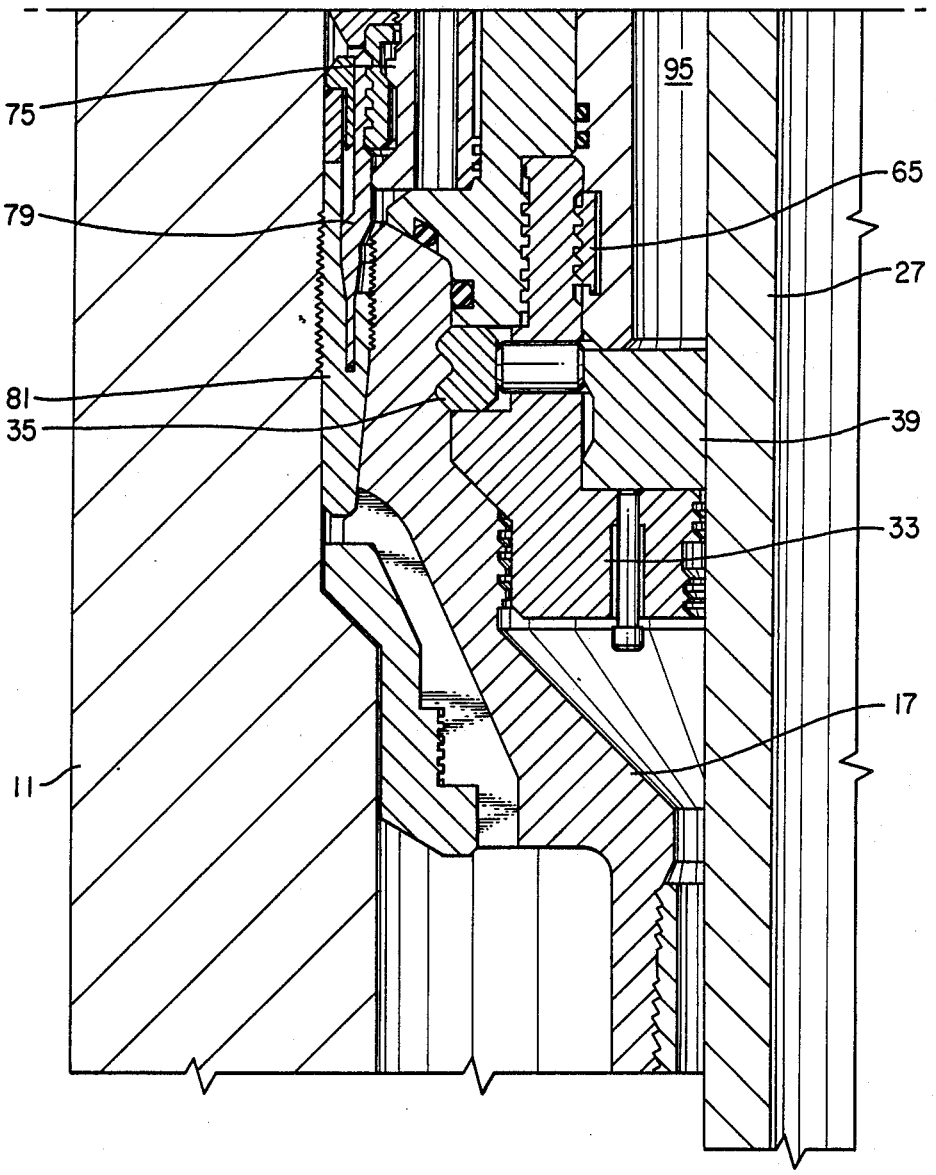

In FIG. 1*b*, the latch ring 65 is positioned above the casing hanger threads 71. In FIGS. 2*b* and 3*b*, the latch ring 65 is engaging the threads 71. The latch ring 65 and threads 71 serve as means for latching the upper body 55 to the lower body 33 when the upper body 55 is in the lower position, to prevent any axial movement of the upper body 55 relative to the lower body 33.

Referring to FIG. 1*a*, the upper body 55 has an outer portion 73 that is substantially the diameter of the wellhead bore 14. The outer portion 73 depends from the upper body 55. A setting sleeve 75 is carried on the upper body outer portion 73. Setting sleeve 75 is secured by a ring 76 that is fixed to the outer portion 73 so that the sleeve 75 can move axially a limited extent relative to the upper body 55. A key (not shown) causes the setting sleeve 75 to rotate in unison with the upper body 55.

Referring to FIG. 1*b*, the setting sleeve 75 is a tubular member that extends downward from the upper body 55. A threaded ring 77 is located on the lower end of the setting sleeve 75. Threaded ring 77 is a split, ratchet type ring that engages threads in a wedge ring 79. The wedge ring 79 is secured to a metal seal packoff 81 by means of a collar 82. The packoff 81 has a central annular cavity 83 that receives the wedge ring 79.

The setting sleeve 75 will move the packoff 81 from an upper position shown in FIG. 1*b* to a lower position shown in the other figures. In the lower position, the packoff 81 is located in the annular clearance 19 between the casing hanger 17 and the wellhead 11. Furthermore, the setting sleeve 75 will move the wedge ring 79 downward from the upper position shown in FIG. 1*b* to a setting position shown in FIG. 3*b*. In that position, the wedge ring 79 expands portions of the packoff 81 on both sides of the cavity 83 to form a metal seal.

While running the casing hanger 17 in and while cementing, fluid in the riser and wellhead bore 14 is free to flow up through a return flow passage 85 in the setting sleeve 79 and a return flow passage 86 in the upper body 55 (FIG. 1*a*).

The lower body upper portion 49 sealingly locates between the upper body 55 and the setting sleeve 75. This is not a closed chamber, however, as fluid is free to flow out through the passages (not shown) in the setting sleeve 75.

After the upper body 55 has been moved to its lower position shown in FIG. 2*b*, the setting sleeve 75 is then moved downward relative to the upper body 55 to set the packoff 81. This is handled by a setting sleeve piston 89 shown in FIG. 1*a*. The setting sleeve piston 89 is carried in a chamber 90 located between the upper body inner portion 91 and upper body outer portion 73. The setting sleeve piston 89 has seals 92 that will sealingly slide within chamber 90. During the setting process, the chamber 90 of the setting sleeve piston 89 will receive a substantially incompressible liquid, such as hydraulic fluid, through hydraulic passages 93. The hydraulic passages 93 communicate with a chamber 95 formed between the bore of the upper body 55 and the exterior of the mandrel 27, as shown in FIG. 2*a*.

A mandrel piston 97 is sealingly carried in the chamber 95. The mandrel piston 97 is secured to the mandrel 27 for movement therewith and protrudes outward. The chamber 95 extends upward from the mandrel piston 97 when the mandrel piston 97 is in the lower position shown in FIG. 2*b*. Chamber 95 is sealed by seals 98 on the mandrel piston 97. The hydraulic passage 93 communicates the chamber 95 of the mandrel piston 97 with the chamber 90 of the setting sleeve piston 89. The hydraulic fluid contained in the chambers 90, 95 and passage 93 is sealed from any exterior fluids in the riser (not shown), wellhead bore 14 or within the drill pipe (not shown). Upward movement of the mandrel piston 97 increases the pressure of the hydraulic fluid in the passage 93 to move the setting sleeve piston 89 downward.

The transverse cross-sectional area or pressure area of the mandrel piston 97 is much less than the cross-sectional area or pressure area of the setting sleeve piston 89. Consequently, the upward force on the mandrel 27 due to the drill string tension is greatly intensified. That is, the downward force exerted by the setting sleeve piston 89 on the setting sleeve 75 will be much higher than the upward force on the mandrel 27. Preferably, the pressure area of the mandrel piston 97 is about one-tenth that of the pressure area of the setting sleeve piston 89, so that 60,000 pounds pull on the drill string will provide a setting force of 600,000 pounds.

Referring to FIG. 2*b*, a lug 99 is formed on the upper side of the mandrel piston 97. The lug 99 is adapted to engage a slot 101 (FIG. 1*a*). Slot 101 is located at the upper interior of the upper body 55. When engaged as shown in FIGS. 1*a* and 4*a*, the upper body 55 will rotate with the mandrel 27.

In operation, the casing (not shown) will be lowered into the well. The upper end of the casing will be secured to the lower end of the casing hanger 17. As shown in FIG. 1*b*, the running tool 25 will be connected to the casing hanger 17 through the ring 35. The upper end of the mandrel 27 of the running tool 25 is connected to the lower end of a string of drill pipe (not shown). Hydraulic fluid will be located in 93. The entire assembly is then lowered into the well until the casing hanger 17 lands on the landing shoulder 13 in the wellhead 11, as shown in FIG. 1*b*.

Then, cement is pumped down the drill pipe. The cement will flow through the bore of the mandrel 27 to the bottom of the casing string, then back up the annulus surrounding the casing string. The returns from the cement will flow through the passages 18 in the casing hanger 17, and up through the passages 85 (FIG. 1*b*) and passages 86 (FIG. 1*a*) to the surface through the riser (not shown).

After the cement has set sufficiently, the drill string is rotated to the right. This disengages the threads 31*a*, 31*b* from the lower body 33, as can be seen by comparing FIG. 1*b* with FIG. 2*b*. Once unscrewed, the drill string is lowered, allowing the mandrel 27 to move downward.

As mandrel 27 moves downward, the lower body 33 will remain stationary because it is seated in the casing hanger 17. The mandrel piston 97 moves downward in mandrel chamber 95, drawing hydraulic fluid from the setting sleeve chamber 90 and passages 93 into the mandrel chamber 95. The upper body 55 under its own weight is free to move downward with the mandrel 27. The cam 39 is also free to move downward under its own weight as shoulder 29 moves down. When cam 39 is at the bottom of cavity 40, mandrel piston 97 will bear against the top of cam 39, stopping further downward movement of mandrel 27. When the cam 39 is in the lower position shown in FIG. 2*b*, the ring 35 will be maintained in the engaged position by means of the upper lobe 41*a*.

When mandrel 27 is in its lower position shown in FIGS. 2*a*, 2*b*, the latch ring 65 (FIG. 1*b*) will be aligned with the threads 71 in the lower body 33. When this occurs, the latch ring 65 snaps outward into engagement with the threads 71. The mandrel shoulder 57 will assure that the upper body 55 reaches the lower position shown in FIGS. 2*a*, 2*b*.

When the upper body 55 is in the lower position, the packoff 81 will be properly positioned in the annular clearance 19 between the casing hanger 17 and the wellhead 11. The upper body 55 will be latched to the lower body 33 so that it can not move upward because of the latch ring 65. The mandrel piston 97 will be located in a lower position at the bottom of the chamber 95.

The drill string is then lifted upward. The upward movement of the mandrel 27 relative to the upper body 55 and lower body 33 causes the mandrel piston 97 to push hydraulic fluid through passage 93 into the setting sleeve chamber 90. Continued upward movement of the mandrel piston 97 causes a pressure increase in the chambers 90, 95 and hydraulic passage 93. The pressure increase acts on the setting sleeve piston 89.

The setting sleeve piston 89 acts on the setting sleeve 75. The setting sleeve 75 applies downward force to the wedge ring 79. The wedge ring 79 moves downward into the cavity 83, which sets the packoff 81. The inner portion of the packoff 81 embeds into the casing hanger wickers 21. The outer portion of the packoff 81 embeds into the wellhead bore wickers 15. The setting position is illustrated in FIGS. 3*a*, 3*b*. When fully set, the upper end of the setting sleeve 75 will be substantially flush with the upper end of the lower body upper portion 49.

After testing, the running tool 25 may be retrieved from the casing hanger 17. First, the drill string is picked up to pull the mandrel 27 upward. At a certain distance, the lug 99 (FIG. 2*a*) will engage the slot 101 as shown in FIG. 4*a*. Then, the drill string is rotated to the right again. The mandrel 27 will rotate. The lug 99 and slot 101 will cause the upper body 55 to rotate with the mandrel 27. This will cause the threaded ring 77 to unscrew from the wedge ring 79. This rotation will also cause the latch ring 65 to unscrew from the threads 71. The mandrel 27 may then be picked up.

As the mandrel 27 is picked up, the shoulder 29 will contact the lower side of the cam 39 and move it up to the intermediate position shown in FIG. 4*b*. The threads 31*a* and 31*b* will contact the mating threads in the lower body 33 to limit the upward movement of the shoulder 29 to the position shown in FIG. 4*b*. The intermediate position of the cam 39 allows the ring 35 to retract. The entire running tool 25 may then be pulled to the surface as shown in FIGS. 4*a*, 4*b*.

The invention has significant advantages. A high force is achieved by using the differential pistons. This high force enables the setting of metal packoffs. Annulus fluid pressure is not needed. There is no need for dropping balls or darts, or to shift pins in J-slots in order to pump fluid down the drill pipe.

While the invention has been shown in only one of its forms, it should be apparent to those skilled in the art that it is not so limited, but is susceptible to various changes without departing from the scope of the invention.

We claim:

1. A tool for setting a packoff between a casing hanger and a wellhead, comprising in combination:

a mandrel having means for connection to a string of drill pipe;

a body carried by the mandrel, the mandrel being axially movable relative to the body;

a setting sleeve carried by the body for connection to the packoff;

a setting sleeve piston carried by the body for movement relative to the body and positioned to contact an upper end of the setting sleeve;

a mandrel piston carried by the mandrel for movement therewith; and means located in the body communicating the mandrel piston with the setting sleeve piston and containing a fluid, whereby movement of the mandrel piston and mandrel relative to the body due to movement of the drill string will increase the pressure of the fluid to exert a downward force on the setting sleeve piston to move the setting sleeve downward to set the packoff.

2. A tool for setting a packoff in an annular space between a casing hanger and a wellhead, comprising in combination:

a mandrel having an upper end for connection to a string of drill pipe;

a body carried by the mandrel, the mandrel being axially movable relative to the body;

connection means on the body for releasably connecting the body to the casing hanger;

a setting sleeve carried by the body for connection to the packoff;

a setting sleeve piston carried by the body for movement relative to the body and positioned to contact an upper end of the setting sleeve;

a mandrel piston carried by the mandrel for movement therewith, the mandrel piston having a smaller pressure area than the setting sleeve piston;

passage means located in the body sealed from the exterior of the body for communicating the mandrel piston with the setting sleeve piston, the passage means containing a substantially incompressible fluid whereby axial movement of the mandrel piston and mandrel relative, to the body due to movement of the drill string will increase the pressure of the fluid to exert a downward force on the setting sleeve piston to move the setting sleeve downward to set the packoff; and release means for releasing the connection means from the casing hanger and the setting sleeve from the packoff to allow the tool to be retrieved after the packoff is set.

3. A tool for setting a packoff in an annular space between a casing hanger and a wellhead, comprising in combination:

a mandrel having an upper end for connection to a string of drill pipe;

a body carried by the mandrel, the mandrel being axially movable relative to the body;

connection means on the body for releasably connecting the body to the casing hanger;

a setting sleeve carried by the body for connection to the packoff;

a setting sleeve piston carried by the body within a setting sleeve chamber for movement relative to the body and positioned to contact an upper end of the setting sleeve;

a mandrel piston carried by the mandrel for movement therewith within a mandrel chamber defined between the body and the mandrel, the mandrel piston having a smaller pressure area than the setting sleeve piston, the mandrel and mandrel piston being movable relative to the body between upper and lower positions, the mandrel piston being located at a lower end of the mandrel chamber when the mandrel piston is in the lower position, the mandrel chamber being filled with a hydraulic fluid when the mandrel piston is in the lower position;

passage means located in the body sealed from the exterior of the body and communicating the mandrel chamber with the setting sleeve chamber, whereby upward movement of the mandrel piston and mandrel relative to the body from the lower position to the upper position due to upward movement of the drill string will increase the pressure of the fluid to exert a downward force on the setting sleeve piston to move the setting sleeve downward to set the packoff; and release means for releasing the connection means from the casing hanger and the setting sleeve from the packoff to allow the tool to be retrieved after the packoff is set.

4. A running tool for running a casing hanger and setting a packoff in an annulus between the casing hanger and a wellhead, comprising in combination:

a mandrel having an upper end for connection to a string of drill pipe;

a lower body carried by the mandrel;

connection means on the lower body for releasably connecting the lower body to the casing hanger;

an upper body carried by the mandrel above the lower body;

a setting sleeve carried by the upper body and adapted to be releasably connected to the packoff;

means for moving the upper body and setting sleeve from an upper position relative to the casing hanger and lower body to a lower position with the packoff located in the annulus between the casing hanger and the wellhead after the casing hanger has been cemented in place;

a setting sleeve piston carried in a setting sleeve chamber in the upper body for movement relative to the upper body and positioned to contact an upper end of the setting sleeve;

a mandrel piston carried by the mandrel for movement therewith in a mandrel chamber located between the mandrel and the upper body;

sealed passage means located in the upper body communicating the mandrel chamber with the setting sleeve chamber and containing a hydraulic fluid, whereby axial movement of the mandrel piston and mandrel due to movement of the drill string after the packoff is in the lower position will increase pressure of the hydraulic fluid to exert a downward force on the setting sleeve piston to move the setting sleeve downward to set the packoff; and release means for releasing the connection means from the casing hanger and the setting sleeve from the packoff to allow the running tool to be retrieved after the packoff is set.

5. A running tool for running a casing hanger and setting a packoff in an annulus between the casing hanger and a wellhead, comprising in combination:

a mandrel having an upper end for connection to a string of drill pipe;

a lower body carried by the mandrel;

connection means on the lower body for releasably connecting the lower body to the casing hanger;

an upper body carried by the mandrel above the lower body;

a setting sleeve carried by the upper body and adapted to be releasably connected to the packoff;

means for moving the upper body and setting sleeve from an upper position relative to the casing hanger and lower body to a lower position with the packoff located between the casing hanger and the wellhead by downward movement of the drill string and mandrel after the casing hanger has been cemented in place;

latch means for latching the upper body to the lower body when the lower body is in the lower position, to prevent upward movement of the upper body relative to the lower body;

a setting sleeve piston carried in a setting sleeve chamber in the upper body for movement relative to the upper body and positioned to contact an upper end of the setting sleeve;

a mandrel piston carried by the mandrel for movement therewith in a mandrel chamber located between the mandrel and the upper body, the mandrel piston having a smaller pressure area than the setting sleeve piston;

passage means sealed from the annulus and located in the upper body for communicating the mandrel chamber above the mandrel piston with the setting sleeve chamber above the setting sleeve piston, the mandrel chamber containing a hydraulic fluid, whereby upward movement of the mandrel piston and mandrel due to upward movement of the drill string after the packoff is in the lower position will increase pressure of the fluid to exert a downward force on the setting sleeve piston to move the setting sleeve downward to set the packoff; and release means for releasing the connection means from the casing hanger and the setting sleeve from the packoff to allow the running tool to be retrieved after the packoff is set.

6. A method for setting a packoff between a casing hanger and a wellhead, comprising in combination:

connecting a mandrel to a string of drill pipe;

mounting a body to the mandrel for axial movement relative to the mandrel;

mounting a setting sleeve to the body and connecting it to the packoff;

mounting a setting sleeve piston in the body above an upper end of the setting sleeve;

mounting a mandrel piston to the mandrel for movement therewith;

providing passages in the body between the mandrel piston with the setting sleeve piston and placing a hydraulic fluid in the passages; and moving the drill string, and along with it the mandrel piston and mandrel relative to the body to increase pressure of the hydraulic fluid in the passages and exert a downward force on the setting sleeve piston to move the setting sleeve downward to set the packoff.

7. A method for running a casing hanger and setting a packoff between the casing hanger and a wellhead, comprising in combination:

connecting a mandrel to a string of drill pipe;

mounting a body to the mandrel for axial movement relative to the mandrel;

mounting a setting sleeve to the body and connecting it to the packoff;

releasably connecting the body to the casing hanger;

mounting a setting sleeve piston in the body above an upper end of the setting sleeve;

mounting, a mandrel piston to the mandrel for movement therewith and providing the mandrel piston with a smaller pressure area than the setting sleeve piston;

providing sealed passages in the body between the mandrel piston with the setting sleeve piston and placing a hydraulic fluid in the passages; and moving the drill string up, and along with it the mandrel piston and mandrel relative to the body to increase pressure in the passages and exert a downward force on the setting sleeve piston to move the setting sleeve downward to set the packoff; then releasing the body from the casing hanger and retrieving the running tool.

* * * * *

UNITED STATES PATENT OFFICE

CERTIFICATE OF CORRECTION

Patent No. 4,903,776 Dated February 27, 1990

Inventor(s) Philippe C. Nobileau, et al

It is certified that error appears in the above-identified patent and that said Letters Patent is hereby corrected as shown below:

At Column 1, Line 61, a period should go after "packoff", and the word "the" should have a capital "T".

At Column 2, Line 47, the numeral "11" should be after "wellhead".

At Column 3, Line 43, the numeral "7" should be "27".

At Column 7, Line 51, the "," should be deleted.

Signed and Sealed this

Sixth Day of August, 1991

*Attest:*

HARRY F. MANBECK, JR.

*Attesting Officer*

*Commissioner of Patents and Trademarks*